US005917431A

United States Patent [19]

Sanada et al.

[11] Patent Number: 5,917,431

[45] Date of Patent: Jun. 29, 1999

[54] DISPLAY SYSTEM FOR A TRAFFIC SIGNAL AND A TRAFFIC SIGNAL

[75] Inventors: Tomohiro Sanada, Mitaka; Terumasa Iba, Tokyo, both of Japan

[73] Assignees: Tokyo Seimitsu Co., Ltd.; OHI Co., Ltd., both of Tokyo, Japan

[21] Appl. No.: 08/876,238

[22] Filed: Jun. 16, 1997

Related U.S. Application Data

[63] Continuation-in-part of application No. 08/536,753, Sep. 29, 1995, abandoned.

[30] Foreign Application Priority Data

Sep. 12, 1995 [JP] Japan ..... 7-234257

[51] Int. Cl.[6] ..... G08G 1/095

[52] U.S. Cl. ..... 340/907; 340/905

[58] Field of Search ..... 340/907, 908, 340/928, 944, 905, 925

[56] References Cited

U.S. PATENT DOCUMENTS 5,136,287 8/1992 Borenstein ..... 340/925

FOREIGN PATENT DOCUMENTS 2 272 318 5/1994 United Kingdom .
WO 91/16698 10/1991 WIPO .
WO 96/36032 11/1996 WIPO .

*Primary Examiner*—Brent A. Swarthout
*Attorney, Agent, or Firm*—Sixbey, Friedman, Leedom & Ferguson; David S. Safran

[57] ABSTRACT

The TS panel can be easily observed with the traffic signal. Multiple pieces of information are changed over to be displayed on the TS panel, and a luminescent color of the information such as traffic condition reports, traffic slogans, advertisements, etc. or a luminescent color of the background of the information is illuminated in the same color as that of a the turned-on light of the signal. A detector detects whether each lamp is turned on or not without modifying an electric circuit of the signal. Then, multiple pieces of information are sequentially changed over in synchronism with a changeover of a turned-on color of the signal in accordance with a detection signal output from the detector, and the luminescent color of the background is changed over to be of a color which is the same color as that of the light currently turned on. As a result, various information can be displayed on the TS panel, and a signal color can be recognized not only by a signal lamp but also a display color of the TS panel.

8 Claims, 8 Drawing Sheets

DISPLAY SYSTEM FOR A TRAFFIC SIGNAL AND A TRAFFIC SIGNAL

CROSS REFERENCE TO RELATED APPLICATION

This application is a continuation-in-part of our U.S. patent application Ser. No. 08/536,753 filed Sep. 29, 1995, now abandoned.

BACKGROUND OF THE INVENTION

1. Field of the Invention

The present invention relates to a display system for a traffic signal and to a traffic signal, and more particularly to a display system for a traffic signal and a traffic signal which display information including traffic condition reports, traffic slogans, advertisements, and the like.

2. Description of Related Art

A traffic signal aims at making the smooth flow of cars and people and at preventing traffic accidents. Accordingly, in a usual traffic signal, three lights (red, yellow and green lights) are time-controlled to light one by one. Moreover, a display board, which displays a place where the traffic signal is installed and an advertisement, is installed on the top, bottom or side portion of the traffic signal.

However, there is a problem in that the display contents become difficult to be understood as it gets darker and darker.

Moreover, there is a problem in that it is hard for drivers and pedestrians to understand a signal light of the traffic signal at daytime because they are dazzled by the sun light.

SUMMARY OF THE INVENTION

It is an object of the present invention to provide a display system for a traffic signal wherein drivers and pedestrians can confirm a signal color easily, traffic condition reports can be confirmed, and an advertisement function by traffic slogans and advertisements is provided.

To achieve the above-mentioned object, a display system for a traffic signal according to the present invention comprises: a display means for displaying information which is at least one of alphabetical, numerical and pictorial, changing a luminescent color of the information to one of green, yellow and red, and being provided at such a position as to be seen together with the traffic signal; a detecting means for detecting whether each of the different colored lamps of the traffic signal is turned on or turned off, and being provided for each of the lamps of the traffic signal without modifying an electric circuit of the traffic signal; and a control means for controlling the luminescent color of the information displayed on the display means to be of a color which is the same as a lighted color of the traffic signal in synchronism with a detection signal output from the detecting means, the luminescent color being controlled in synchronism with a changeover of the lighted color of the traffic signal from one color to another.

The display means displays plural pieces of information, and the control means successively changes over the plural pieces of information displayed on the display means in accordance with a detection signal from the detecting means so as to display desired information on the display means in synchronism with changeover of a lighted color of the traffic signal.

Further, a display system for a traffic signal according to the present invention comprises: a display means for displaying information which is at least one of alphabetical, numerical and pictorial on a display screen thereof, successively changing over multiple pieces of information to display respective desired information, changing a luminescent color of a background of the information on the display screen to one of green, yellow and red, and being provided at such a position as to be seen together with the traffic signal; a detecting means for detecting whether each of the different colored lamps of the traffic signal is turned on or turned off, and being provided for each of the lamps of the traffic signal without modifying an electric circuit of the traffic signal; and a control means for successively changing over the multiple pieces of information in synchronism with a detection signal output from the detecting means so as to display respective desired information on the display means, the desired information being changed in synchronism with a changeover of a lighted color of the traffic signal from one color to another, and for controlling the luminescent color of the background of the information on the display screen to be of a color which is the same as a lighted color of the traffic signal in synchronism with the detection signal output from the detecting means, the luminescent color being controlled in synchronism with the changeover of the lighted color of the traffic signal from one color to another.

Therefore, the signal color can be confirmed not only by the signal lamp but also by the display color of the display means, and various information displayed in the display means can be confirmed simultaneously. Furthermore, plural pieces of information are changed over to be displayed in synchronism with a changeover of a turned-on color of the signal, so that the amount of information displayed on the display means can be increased.

According to the other mode, a traffic signal according to the present invention comprises: a surface luminescence means for displaying information which is at least one of alphabetical, numerical and pictorial on a display screen thereof, and changing over a luminescent color of the information among green, yellow and red, or among green and red; and a control means for successively changing over the luminescent color of the information to green, yellow and red, or green, blinking green and red in a predetermined timing.

The surface luminescence means displays multiple pieces of information, and the control means sequentially changes over the luminescent color of the background to green, yellow and red, or green, blinking green and red in a predetermined timing and the control means successively changes over the multiple pieces of information displayed on the surface luminescence means in the predetermined timing.

Furthermore, a traffic signal according to the present invention comprises: a surface luminescence means for displaying information which is at least one of alphabetical, numerical and pictorial on a display screen thereof, and changing over a luminescent color of a background of the information on the display screen among green, yellow and red, or among green and red; and a control means for successively changing over the luminescent color of the background of the information on the display screen to green, yellow and red, or green, blinking green and red in a predetermined timing.

Thus, when the traffic signal according to the present invention is compared with the conventional one having the same size, the luminescent area will become bigger and thereby the visibility is improved. In the case of the traffic signal for pedestrians, "WALK", "STOP" or pedestrian marks indicating them, etc. are changed over to be displayed in accordance with the color of the background, and the displayed contents of the traffic signal can be correctly recognized.

BRIEF DESCRIPTION OF THE DRAWINGS

The nature of this invention, as well as other objects and advantages thereof, will be explained in the following with reference to the accompanying drawings, in which reference characters designate the same or similar parts throughout the figures and wherein.

DETAILED DESCRIPTION OF THE PREFERRED EMBODIMENTS

A detailed description will hereunder be given of the preferred embodiment of a traffic signal, a display system therefor according to the present invention with reference to the accompanying drawings.

Figure 1:
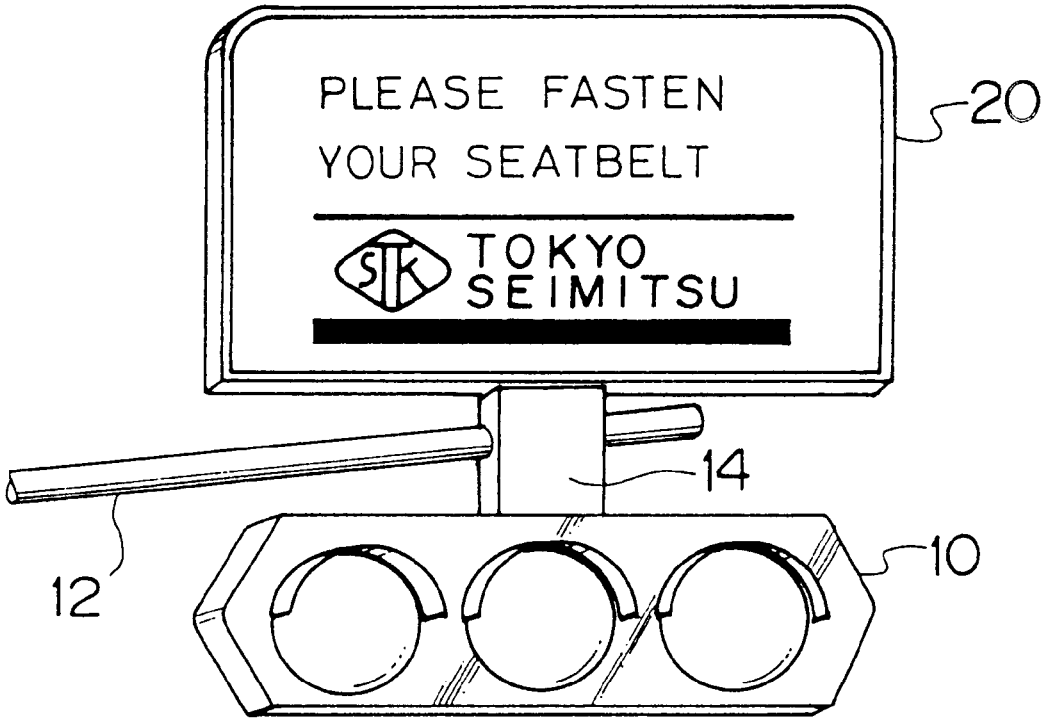
FIG. 1 is an external view showing the state that the display system for the traffic signal according to this invention is installed in the traffic signal.

FIG. 1 is an external view showing the state that a Traffic Safety panel (hereafter, it is called the TS panel) which composes the display system for the traffic signal according to this invention is installed in the traffic signal. In FIG. 1, 10 is a well-known traffic signal which consists of three colors including green, yellow and red and attached to a support pole 12 from an electric pole (not shown) downward via a bracket 14.

20 is a TS panel, such as a color plasma display panel. This TS panel 20 is installed in the upper part of the traffic signal 10 via the bracket 14 and observed simultaneously with the traffic signal 10.

Figure 2:
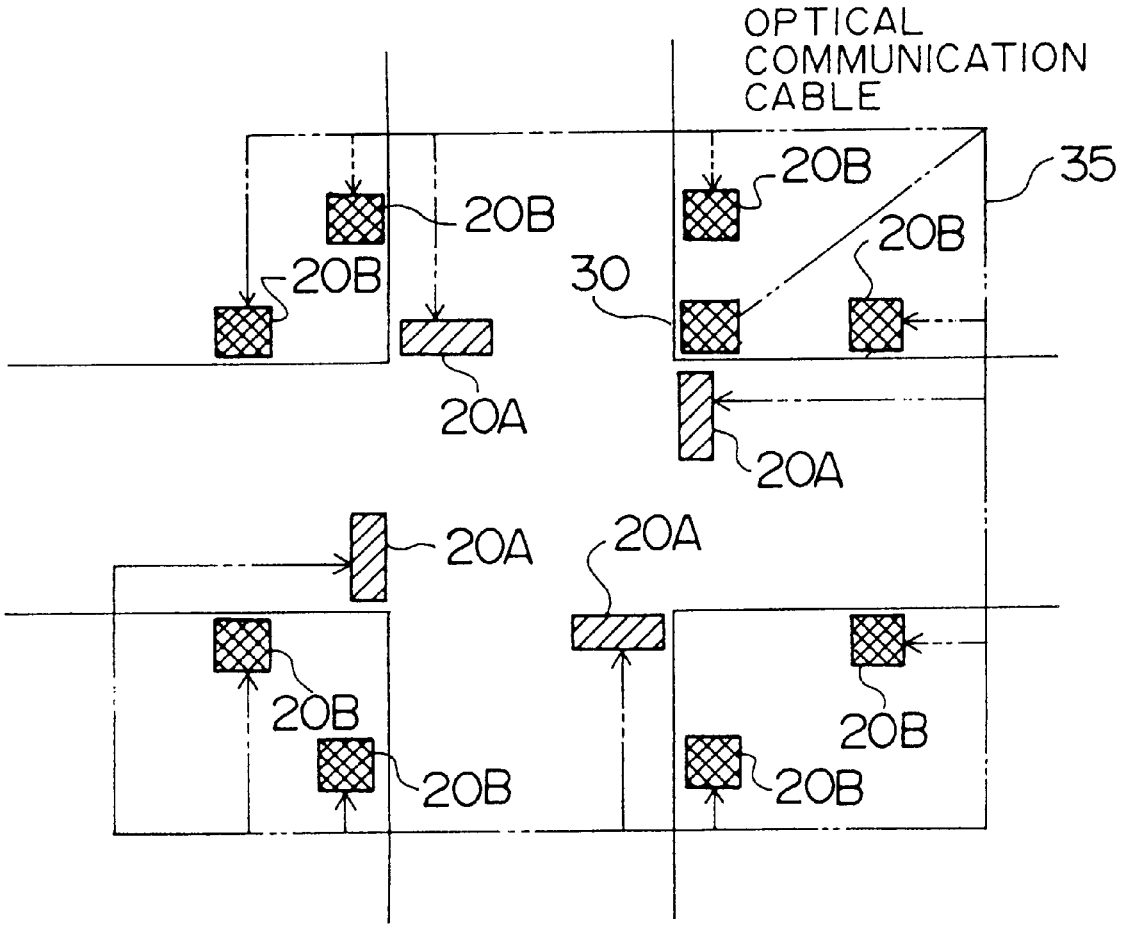
FIG. 2 is a view showing an arrangement example of the Traffic Safety panel and the controller at the crossroad intersection.

At an intersection of a crossroad shown in FIG. 2, for instance, 4 TS panels 20A attached to traffic signals for cars and 8 TS panels 20B attached to traffic signals for pedestrians, that is, 12 TS panels are installed. The 12 TS panels 20A and 20B are controlled simultaneously by a controller 30 via optical communication cables 35 about display patterns of panel surfaces.

Figure 3:
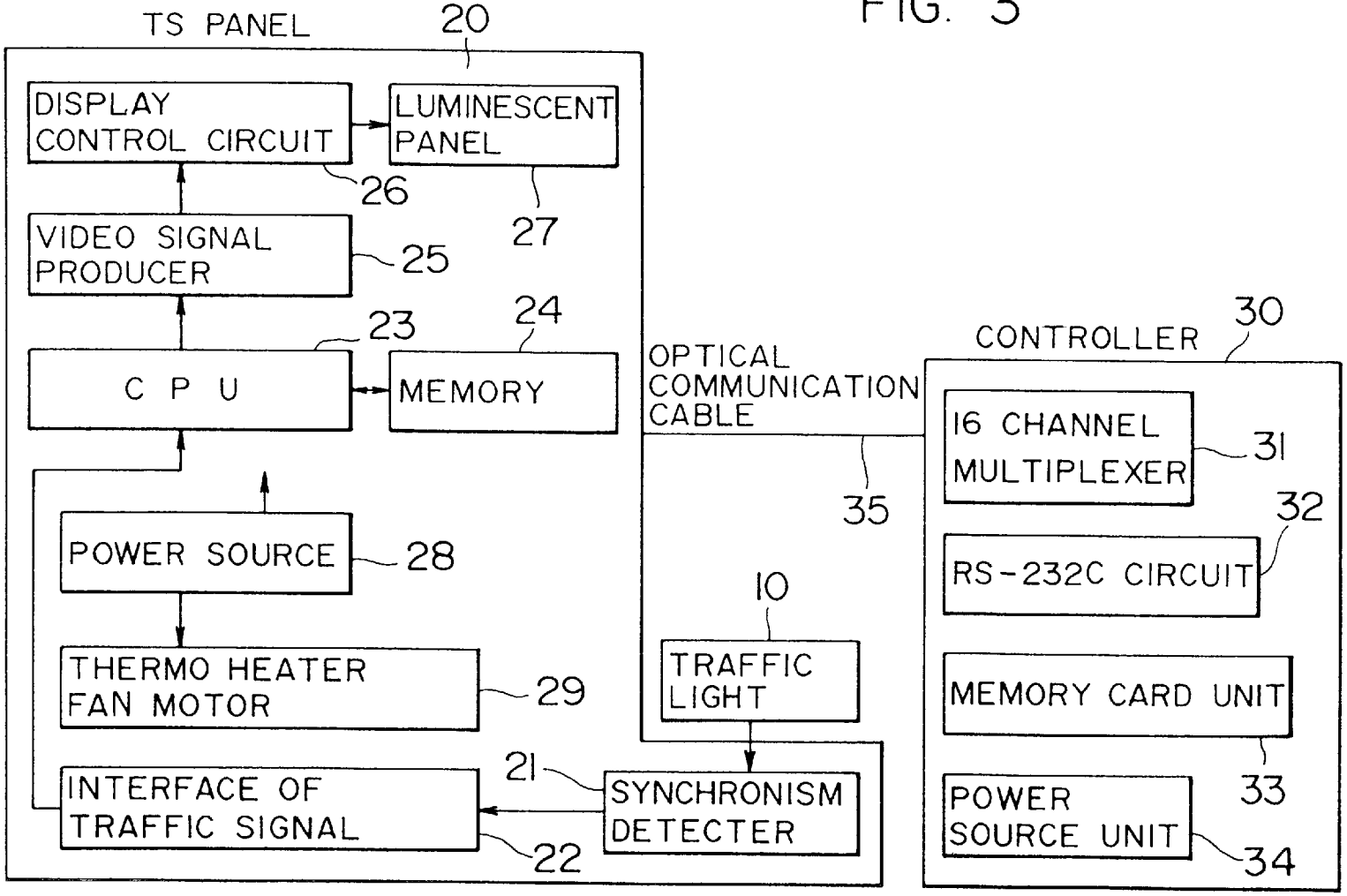
FIG. 3 is a block diagram showing a composition example of the Traffic Safety panel and the controller.

FIG. 3 is a block diagram showing one embodiment of an internal composition of the TS panel 20 and the controller 30. The TS panel 20 consists mainly of a synchronism detector 21, a central processing unit (CPU) 23, a memory 24, a video signal producer 25, a display control circuit 26 and a luminescent panel 27, and the controller 30 is mainly composed of a 16-channel multiplexor 31, a RS-232C circuit 32 for optical communication, a memory card unit 33 and a power source unit 34 as shown in FIG. 3.

The controller 30 is operated when the display patterns such as traffic condition reports, traffic slogans or advertisements displayed on the TS panel 20 are changed, and memory cards for the memory card unit 33 are replaced. Thus, display pattern data recorded in the memory card is read and is transmitted to the respective TS panels 20 via the RS-232C circuit 32, the 16-channel multiplexor 31 and the optical communication cable 35.

The display pattern data transmitted from the controller 30 is memorized in the memory 24 through an interface (not shown) for the optical communication of the TS panel 20 and through the CPU 23.

Synchronism signals are transferred from the synchronism detector 21 to the CPU 23 of the TS panel 20 through a signal interface 22. This synchronism detector 21 is a detector which is disposed for each color lamp of the traffic signal 10 and outputs the synchronism signals indicating the state of each lamp which is turned on or turned off, but is not electrically connected to an electric circuit of the traffic signal 10.

Figure 4:
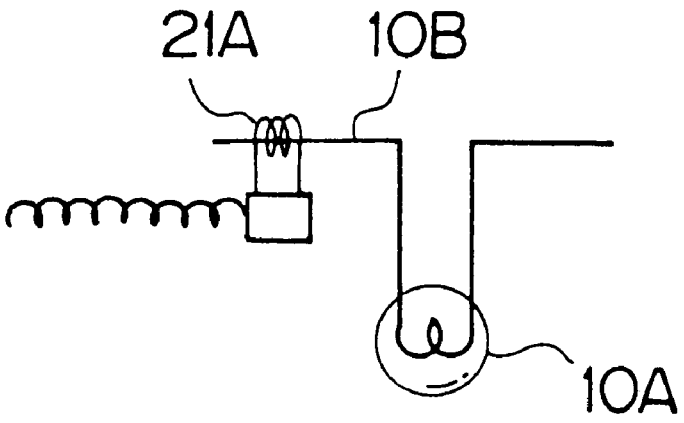
FIG. 4 is a view showing a detector shown in FIG. 3.
Figure 5:
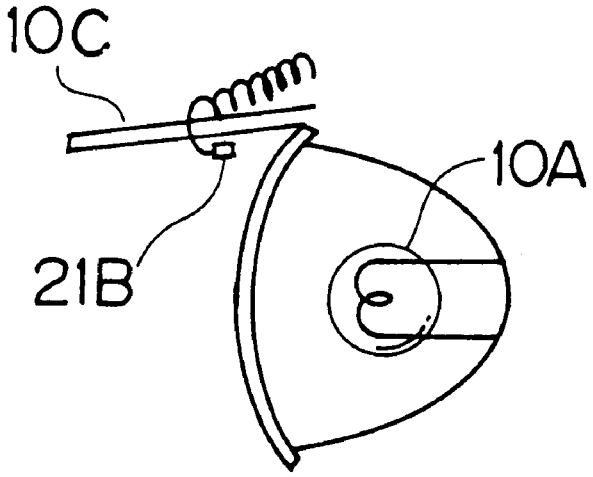
FIG. 5 is another example of the synchronous detector.

The synchronism detector 21 may consist of a detector, as shown in FIG. 4, wherein a coil 21A is wound on to each lead 10B to light each lamp 10A of the traffic signal 10, and the magnetic field produced by electric current flowing when the lamp 10A is turned on is converted into an electric signal and another detector, as shown in FIG. 5, comprising a photo sensor 21B which is disposed opposite to each lamp 10A of the traffic signal and converts the light when the lamp is turned on into an electric signal. 10C is a sunshade cover of the lamp in FIG. 5.

In FIG. 3, the CPU 23 reads out display pattern data which is memorized in accordance with a turned-on color of the lamp, from the display pattern data memorized in the memory 24 on a basis of a synchronism signal, which is input via the signal interface 22 and indicates a color of a lamp which is currently turned on. Then, the CPU 23 outputs video signals to the display control circuit 26 through the video signal producer 25 to make, for instance, the luminescent color of information such as advertisement characters and patterns in white color and the color of the background luminescent in a color which is the same as the turned-on color of the signal, and the display control circuit 26 makes the TS panel 20 display in accordance with the input video signal.

Figure 6A:
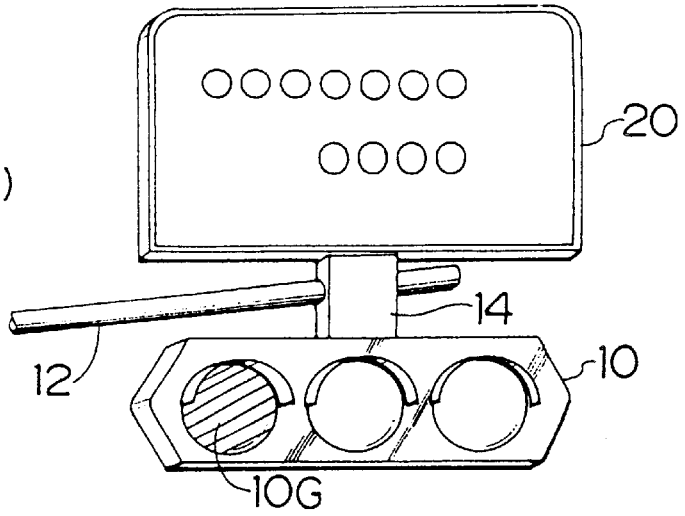
FIGS. 6 (A), 6 (B) and 6 (C) are views showing a turned-on color of a traffic signal and a display information on the TS panel.
Figure 6B:
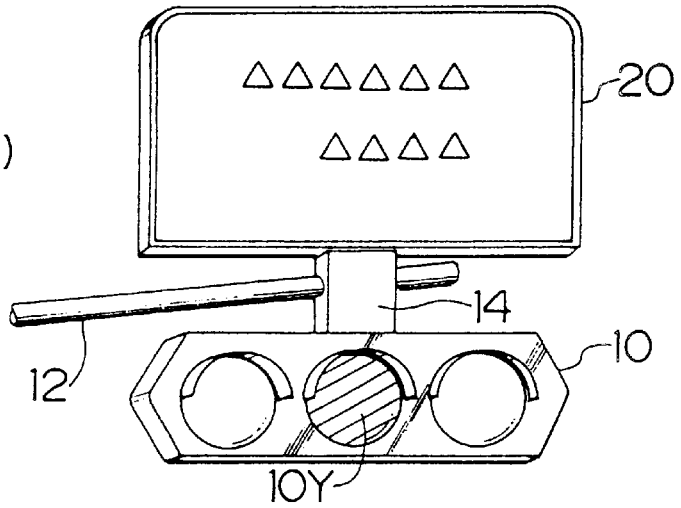
Figure 6C:
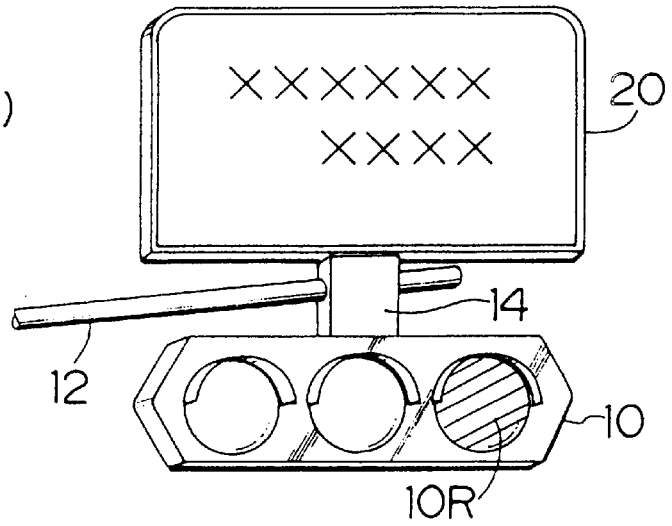

That is, in the case when a green lamp 10G of the traffic signal 10 is turned on as shown in FIG. 6 (A), the information corresponding to the green color is displayed on the TS panel 20, and its background color on the TS panel 20 is made to be green. Likewise, in the case when a yellow lamp 10Y of the traffic signal 10 is turned on as shown in FIG. 6 (B), the information corresponding to the yellow color is displayed on the TS panel 20, and the background color is made to be yellow. In the case when a red lamp 10R of the traffic signal 10 is turned on as shown in FIG. 6 (C), the information corresponding to the red color is displayed on the TS panel 20, and the background color is made to be red. A thermo heater and a fan motor 29 are driven by the power source 28 to keep the TS panel 20 at a temperature between 0–45° C. Moreover, the power source 28 supplies the power to respective circuits of the TS panel 20.

According to the above-described structure, the information such as characters of advertisements, patterns, etc. is illuminated white on the panel surface of the TS panel 20, and the background color is changed over to be the same luminescent color as that of the traffic signal in synchronism with the changeover of the traffic signal from one color to another. The information such as advertisement characters, patterns, etc. is luminescent in white. However, the information may be luminescent in colors except for green, yellow and red, or the information may not be luminescent at all.

The TS panel 20 can provide various kinds of information with drivers and pedestrians, and the entire panel surface is changed over to be the same luminescent color as that of the traffic signal, so the TS panel surface can serve as an auxiliary traffic signal which can be easily seen from a distance. Moreover, the TS panel 20 is completely separated from an electric system of the traffic signal, so the reliability of the traffic signal cannot be damaged.

Incidentally, in this embodiment, information displayed on the TS panel 20 is changed over in accordance with the turned-on color of the traffic signal, however, the present invention should not be limited to this. For example, more than three pieces of information may be memorized in the memory 24, so that the information can be successively changed over in synchronism with a changeover of the signal. Moreover, The TS panel is composed of the color plasma display panel, but the present invention should not be limited to this. For example, the TS panel may be composed of a light-emitting diode panel or a liquid crystal display panel.

Furthermore, in this embodiment, the background color on the TS panel 20 is changed according to the lighted color of the traffic signal; however, the present invention should not be restricted to this. The background color of the TS panel 20 may be fixed (including the color which is not luminescent), and the luminescent color of the information displayed on the TS panel 20 may be changed to be the same color as the lighted color of the traffic signal in synchronism with the changeover of the lighted color of the traffic signal from one color to another. Moreover, the information may be changed at the same time with the changeover of the luminescent color of the information displayed on the TS panel 20.

Next, a detailed description will be given of one embodiment of a traffic signal according to this invention.

Figure 7A:
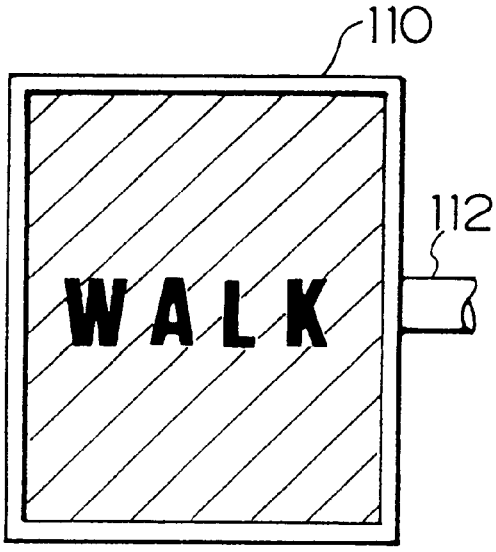
FIGS. 7 (A) and (B) are external views respectively showing an example of a display in a traffic signal according to the present invention.
Figure 7B:
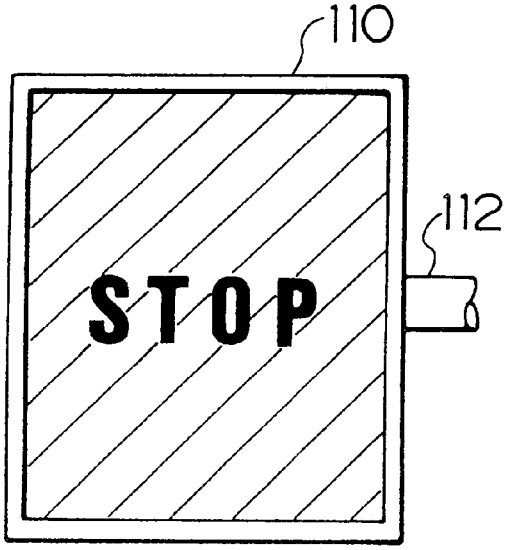

In FIG. 7, 110 is a luminescence panel, which is the display part of a traffic signal for pedestrians according to this invention, such as a color plasma display panel. This luminescent panel 110 is supported by a supporting pole 112 of a electric pole (not shown).

Figure 8:
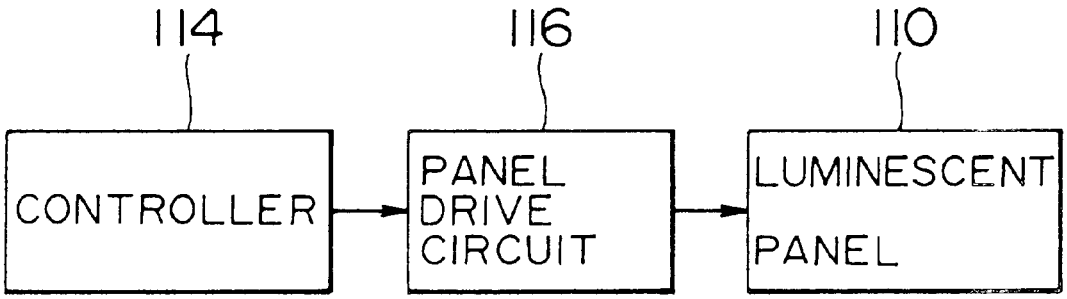
FIG. 8 is a block diagram of a traffic signal according to the present invention.

The luminescent panel 110, as shown in FIG. 8, is controlled by a controller 114 and a panel drive circuit 116 for luminescence and displaying. That is, the controller 114 contains a timer and successively outputs control signals which change the luminescent color of the luminescent panel 110 over to green, blinking green and red, to the panel drive circuit 116 at every predetermined time. When the luminescent color is green, the controller 114 outputs pattern signal which represents characters "WALK" in white (see FIG. 7 (A)) to the panel drive circuit 116. When the luminescent color is red, the controller 114 outputs pattern signal which represents characters "STOP" in white (see FIG. 7 (B)) to the panel drive circuit 116. The panel drive circuit 116 makes the luminescence surface of the luminescent panel 110 as a whole luminescent in the luminescent color designated by the control signal and makes the luminescent panel 110 display the characters represented by the pattern signal in white.

Figure 9A:
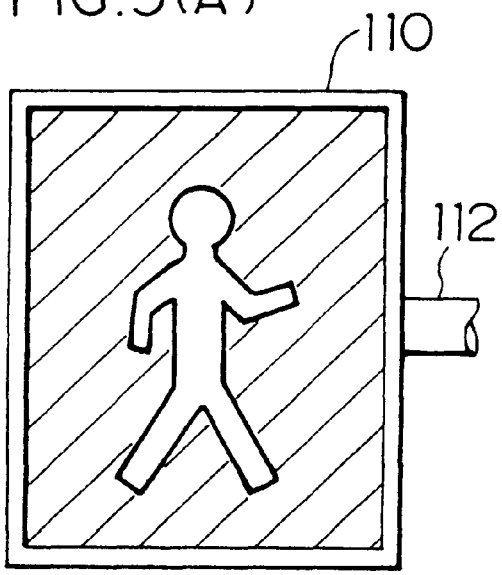
FIGS. 9 (A) and (B) are external views illustrating another example of a display in a traffic signal according to the present invention.
Figure 9B:
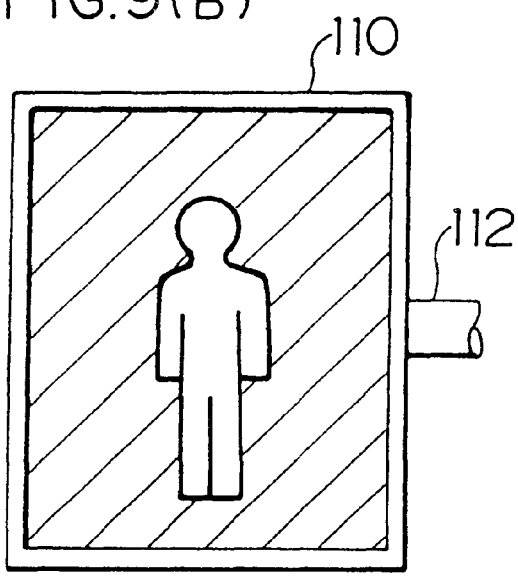

Incidentally, as information displayed in the traffic signal for pedestrians, as shown in FIGS. 9 (A) and (B), pedestrian marks representing that a pedestrian walks and stops may be displayed instead of the above-described character information. The marks may be displayed in addition to the characters.

With this arrangement, the luminescence surface of the luminescent panel 110 as a whole is made luminescent in one color. Therefore, when the above-mentioned traffic signal is compared with the conventional one having the same size, the luminescent area will become bigger, so that the visibility is improved. Further, the description has been given of the case which the color plasma display panel is used as a luminescence panel in the above embodiment; however, the present invention should not necessarily be limited to this, and a fluorescent display tube, a luminescent diode panel or a liquid crystal display may be used.

Furthermore, in this embodiment, the whole luminescent surface of the luminescent panel 110 is made luminescent in the color designated by the control signal, and the characters and the marks designated by the pattern signal are displayed on the luminescent surface. The present invention, however, should not be restricted to this. The background color on the luminescent panel 110 may be fixed (including the color which is not luminescent), and the characters and marks displayed on the luminescent panel 110 may be made luminescent in the color designated by the control signal. The characters and marks displayed on the luminescent panel 110 may be changed over at the same time with the changeover of the luminescent color of the characters and marks from one color to another.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. A display system for a traffic signal comprising:

display means for displaying multiple pieces of information which are at least one of alphabetical, numerical and pictorial, changing a luminescent color of the information to one of green, yellow and red, and being provided at such a position as to be seen together with said traffic signal;

detecting means for detecting whether each of the different colored lamps of said traffic signal is turned on or turned off, and said detecting means being provided for each of said lamps of said traffic signal without modifying an electric circuit of said traffic signal; and control means for controlling the luminescent color of the information displayed on said display means to be of a color which is the same as a lighted color of said traffic signal in synchronism with a detection signal output from said detecting means, the luminescent color being controlled in synchronism with a changeover of the lighted color of said traffic signal from one color to another; wherein said control means successively changes over the multiple pieces of information displayed on said display means in synchronism with the detection signal output from said detecting means so as to display respective desired information on said display means, the desired information being changed in synchronism with the changeover of the light color of said traffic signal from one color to another;

wherein the multiple pieces of information include a first set of information which is related to the color of the lamps of the traffic signal that are turned on, and a second set of information which unrelated to the color of the lamps of the traffic signal that are turned on, both of said sets of information changing in response to detection by said detecting means of a change in the color of the lamps of the traffic signal that are turned on or turned off.

2. The display system for the traffic signal as defined in claim 1, wherein the information is at least one part of a traffic condition report, a traffic slogan and an advertisement.

3. The traffic signal as defined in claim 1, wherein said second set of information is at least in part comprised of an advertisement.

4. The traffic signal as defined in claim 1, wherein said second set of information is at least in part comprised of a traffic condition report.

5. A display system for a traffic signal comprising:

display means for displaying multiple pieces of information which are at least one of alphabetical, numerical and pictorial on a display screen thereof, successively changing over multiple pieces of information to display respective desired information, changing a luminescent color of a background of the information on said display screen to one of green, yellow, and red, and being provided at such a position as to be seen together with said traffic signal;

detecting means for detecting whether each of the different colored lamps of said traffic signal is turned on or turned off and said detecting means being provided for each of said lamps of said traffic signal without modifying an electric circuit of said traffic signal; and control means for successively changing over the multiple pieces of information in synchronism with a detection signal output from said detecting means so as to display respective desired information on said display means, the desired information being changed in synchronism with a changeover of a lighted color of said traffic signal from one color to another, and for controlling the luminescent color of the background of the information on said display screen to be of a color which is the same as a lighted color of said traffic signal in synchronism with the detection signal output from said detecting means, the luminescent color being controlled in synchronism with the changeover of the lighted color of said traffic signal from one color to another;

wherein the multiple pieces of information include a first set of information which is related to the color of the lamps of the traffic signal that are turned on, and a second set of information which unrelated to the color of the lamps of the traffic signal that are turned on, both of said sets of information changing in response to detection by said detecting means of a change in the color of the lamps of the traffic signal that are turned on or turned off.

6. The display system for the traffic signal as defined in claim 5, wherein the information is at least one part of a traffic condition report, a traffic slogan and an advertisement.

7. The traffic signal as defined in claim 5, wherein said second set of information is at least in part comprised of an advertisement.

8. The traffic signal as defined in claim 5, wherein said second set of information is at least in part comprised of a traffic condition report.

* * * * *